United States Patent [19]

Ikeda

[11] Patent Number: 5,044,972

[45] Date of Patent: Sep. 3, 1991

[54] ELECTRIC CONNECTOR

[75] Inventor: Tomohiro Ikeda, Shizuoka, Japan

[73] Assignee: Yazaki Corporation, Tokyo, Japan

[21] Appl. No.: 487,091

[22] Filed: Mar. 2, 1990

[30] Foreign Application Priority Data

Mar. 17, 1989 [JP] Japan ..... 1-63792

[51] Int. Cl.[5] ..... H01R 11/22

[52] U.S. Cl. ..... 439/268; 439/752; 439/595

[58] Field of Search ..... 439/733, 744, 266, 268, 439/270, 595, 596, 603, 752

[56] References Cited

U.S. PATENT DOCUMENTS

| | | | |
|---|---|---|---|
| Re. 30,277 | 5/1980 | Simmons | 439/268 |
| Re. 31,142 | 2/1983 | Simmons | 339/74 |
| 4,558,913 | 12/1985 | Goto et al. | 439/268 |
| 4,753,612 | 6/1988 | Betsui | 439/266 |

FOREIGN PATENT DOCUMENTS

| | | | |
|---|---|---|---|
| 1597164 | 9/1981 | United Kingdom | 439/268 |

*Primary Examiner*—David L. Pirlot

*Attorney, Agent, or Firm*—Armstrong, Nikaido, Marmelstein, Kubovcik & Murray

[57] ABSTRACT

The connector of this invention has a connector housing with a terminal accommodating chamber formed therein, into which a female terminal is to be assembled. A release bar is formed separately from the connector housing. With the release bar mounted on the connector housing, the female terminal is inserted into the connector. As the female terminal advances in the terminal accommodating chamber, its front end abuts against and then slides along the tapered surface of the front portion of the release bar, forcing it up. At the same time the female terminal slides over a lance formed in the connector housing. As it further advances, the front end of the lance engages with a hole in the underside of the female terminal and the front portion of the release bar snaps into an opening formed in the upper side of the female terminal. The female terminal in this way is doubly locked by the lance and by the front end of the release bar. If the lance fails to fit into the hole of the female terminal, the front portion of the release bar rests on the female terminal, projecting markedly from the houisng, which is easily recognizable from outside. This in turn alerts the assembly worker to the incorrect mounting.

7 Claims, 8 Drawing Sheets

ELECTRIC CONNECTOR

BACKGROUND OF THE INVENTION

1. Field of the Invention

The present invention relates to an electric connector containing a female terminal and more particularly to an electric connector which provides secure engagement with and release from a mating male terminal and which prevents incomplete mounting of the female terminal in its housing.

An example of a prior art connector having a female terminal that engages with a male connector is shown in FIGS. 11 and 12 (Japanese Patent Preliminary Publication No. Showa 58-212081). A female terminal F consists of a base plate a of a thin metal plate which has a male terminal receptor portion $F_1$ at the front and a wire connecting portion $F_2$ at the back. In the male terminal receptor portion $F_1$ there is a resilient tongue b, which is formed by folding back the front end of the base plate a to make it extend rearwardly between vertical side walls c and between the base plate a and a top plate d.

The resilient tongue b is divided by two slits into three parts, of which a central resilient lock piece $b_1$ is formed with a raised projection e at the intermediate portion and has its free end bent upward at right angles forming a riser f. Side pieces $b_2$ of the resilient tongue b are curved so that their front ends c are almost in contact with the base plate a.

The male terminal G, as shown in FIG. 12, is inserted between the top plate d and the resilient tongue b of the female terminal F fitted in the connector H. The raised projection e on the central resilient lock piece $b_1$ of the tongue b engages with a hole h cut in the male terminal G, locking them together. The male terminal G is pressed against the resilient tongue b with a sufficient contact pressure, which is produced by the elasticity of the tongue b and by the reactionary force of the front ends q of the side pieces $b_2$ contacting the base plate a, thus providing an electrical connection.

To release the lock, the riser f of the resilient lock piece $b_1$ is pressed down by a lever i mounted to the connector H to disengage the projection e from the hole h of the male terminal G.

With the prior art mentioned above, when the length of the male terminal G, $l_1$, is longer than the distance from the front of the connector H to the front of the riser f of the resilient lock piece $b_1$, $l_2$, the front end of the male terminal G may hit strongly against the riser f, deforming the resilient tongue b or resilient lock piece b.This gives rise to a problem that the projection e may not be able to engage with the hole h of the male terminal G. Furthermore, once the resilient tongue b gets deformed, the contact pressure between the male and female terminals decreases, leading to faulty contact. The riser f, though essential for disengagement of the lock, can cause deformation in the resilient tongue b and the resilient lock piece $b_1$.

The female terminal F engages with a lance j formed in the connector H and is fixed at a predetermined position in the terminal accommodating chamber of the connector H. Whether or not the engagement between the female terminal F and the lance j is complete cannot be seen from outside. That is, there is no means to check for improper contact of the male and female terminals G and F.

This invention has been accomplished under these circumstances and is intended to provide an electric connector, which ensures reliable connection and disconnection between the mating male and female terminals; which has no possibility of the resilient contact portion of the female terminal being deformed; and which can prevent improper assembling of the female terminal and the connector housing.

SUMMARY OF THE INVENTION

To achieve the above objective, the present invention provides an electric connector which comprises: a connector housing having a terminal accommodating chamber therein and also an opening formed in its surrounding wall, the opening communicating with the terminal accommodating chamber inside the connector housing; a female terminal installed in the terminal accommodating chamber in the connector housing, the female terminal having a lock mechanism to lock an incoming male terminal, the female terminal further comprising: a base plate; a male terminal receptor portion formed integral with the front part of the base plate, the male terminal receptor portion being formed into the shape of a channel or frame; a wire connecting portion connected to the rear part of the base plate; and a resilient tongue formed by folding back, like a letter U, the base plate at the front end of the male terminal receptor portion so that the folded part of the base plate extends rearwardly until its free end projects from the rear end of the male terminal receptor portion and is also exposed from the opening of the connector housing; and a lock release bar having its front end disposed in the opening of the connector housing, the front end of the lock release bar being in contact with the resilient tongue and also movable in a direction almost perpendicular to the resilient tongue to release the lock between the mating terminals.

These and other objects and features of this invention will be described in detail by referring to the accompanying drawings illustrating one embodiment of the invention.

DESCRIPTION OF THE PREFERRED EMBODIMENT

Figure 1:
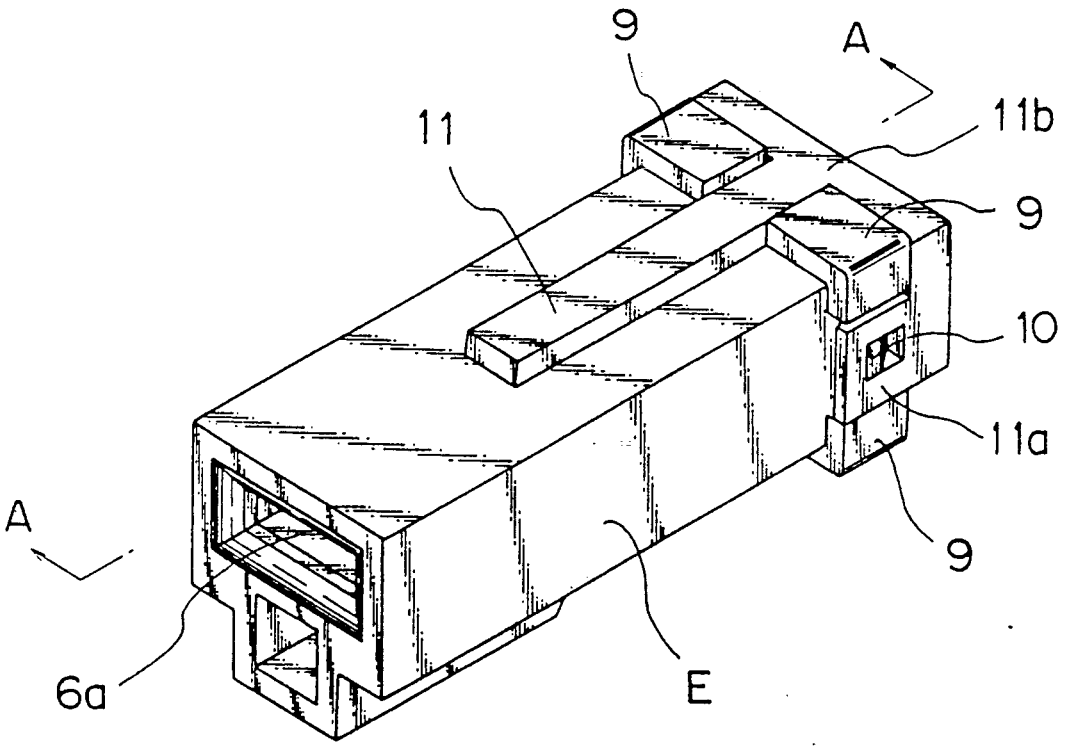
FIG. 1 is a perspective view of an assembled connector of this invention.

Referring to FIG. 1, reference symbol E represents a connector housing in which a female terminal is installed. Denoted 11 is a release bar formed separate from the connector housing E.

We will describe the construction of the female terminal, connector housing E and release bar 11, in that order.

Figure 2:
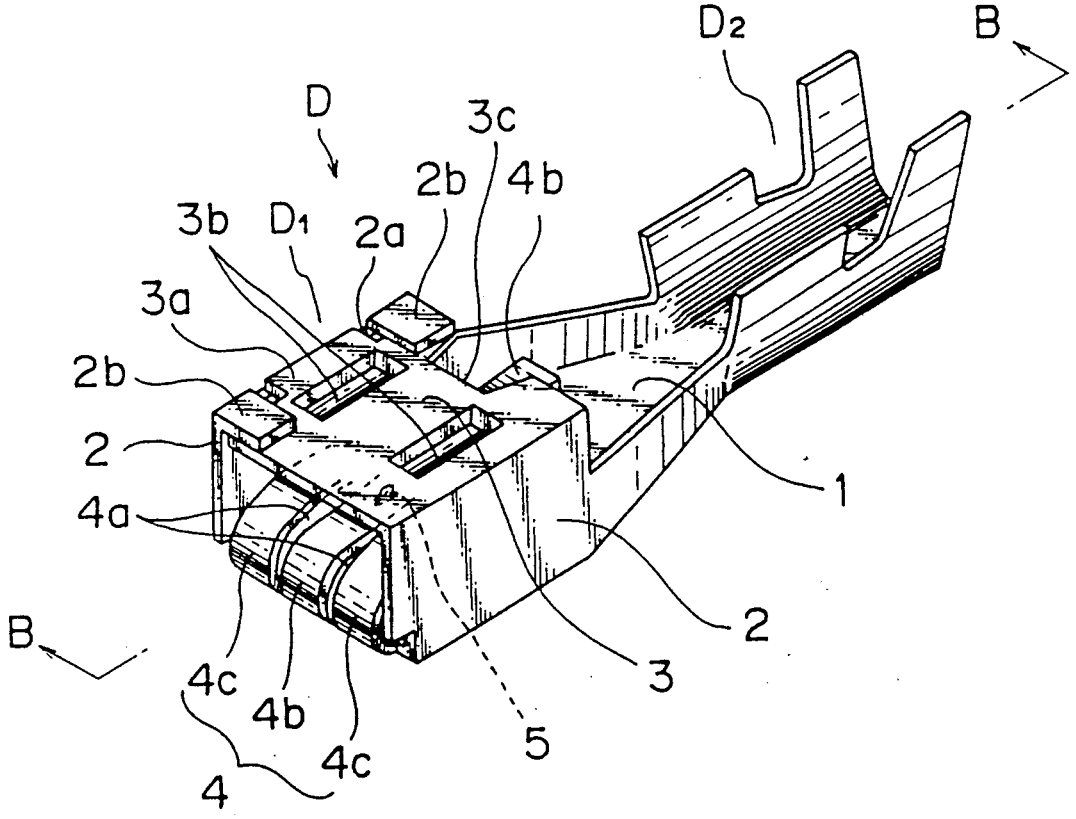
FIG. 2 is a perspective view of a female terminal in the connector of FIG. 1.
Figure 3A:
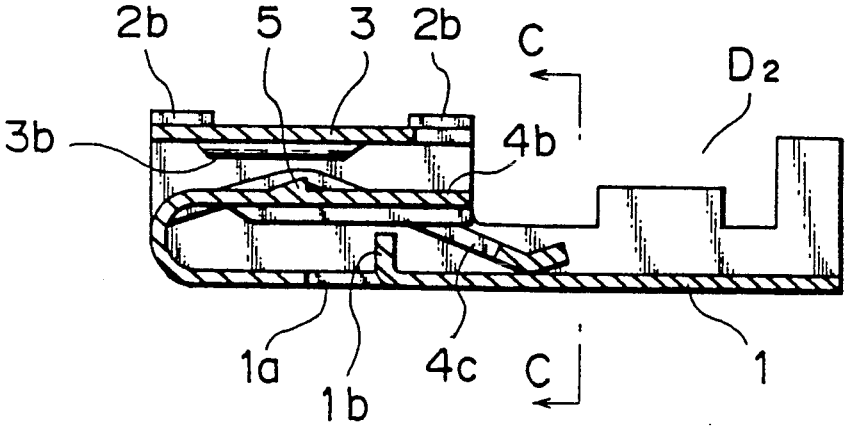
FIG. 3A is a cross section taken along the line B—B of FIG. 2.
Figure 3B:
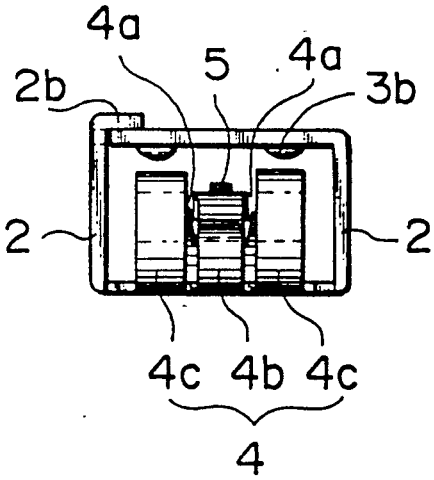
FIG. 3B is a left side view of FIG. 3A.
Figure 3C:
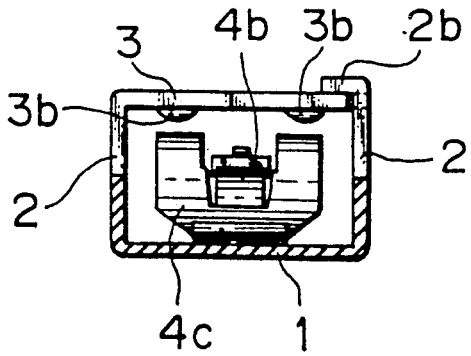
FIG. 3C is a cross section taken along the line C—C of FIG. 3A.

As shown in FIGS. 2 and 3, the female terminal D consists of a base plate 1, a male terminal receptor portion $D_1$ at the front of the base plate 1, and a wire connecting portion $D_2$ at the rear, these three portions being formed integral as one piece.

One of side walls 2 integrally erected from both sides of the front portion of the base plate 1 is bent at an intermediate portion toward the other side wall 2 to form a top plate 3. A central portion 3*a* at the free end of the top plate 3 fits into a recess 2*a* of the second side wall 2 and rests on the top end surface of the second side wall 2. Protuberances 2*b* on each side of the recess 2*a* are bent to hold the top plate 3, thus forming the male terminal receptor portion $D_1$. The top plate 3 is formed with two contact projections 3*b*, that are embossed to project inside the male terminal receptor portion $D_1$.

The front end of the base plate 1 is folded back like a letter U to form a resilient tongue 4, which is divided into three parts by two slits 4*a* and extends backwardly in the male terminal receptor portion $D_1$. Of these three divided parts, a central resilient lock piece 4*b* is disposed almost parallel to the base plate 1 and is formed at an intermediate portion with a raised projection 5. The free end of the lock piece 4*b* projects beyond the back of the male terminal receptor portion $D_1$. In the example shown, it is exposed from a recess 3*c* of the top plate 3. The resilient lock piece 4*b* has its sides bent down so that the cross section is U-shaped to increase it strength. Press pieces 4*c* at each side of the resilient tongue 4 are curved like a mountain peak toward the base plate 1, with which their front ends are in resilient contact. The front ends of the press pieces 4*c* are connected together so that they will slide on the base plate 1 simultaneously.

While, in this example, the resilient tongue 4 is divided by the slits 4*a* to form the resilient lock piece 4*b* and the side pressing pieces 4*c*, it is also possible to form them as one piece.

The base plate 1 has an engagement hole 1*a* at a position opposite to the resilient lock piece 4*b*. Three of the four sides of the engagement hole 1*a* are cut in the base plate 1 and the cut portion is erected to form a support piece 1*b*. The engagement hole 1*a* is for receiving the lance formed in the connector housing. The support piece 1*b* is to prevent the resilient lock piece 4*b* from deflecting in excess of its limit of elasticity and is located a slightly away from the resilient lock piece 4*b*.

Figure 4:
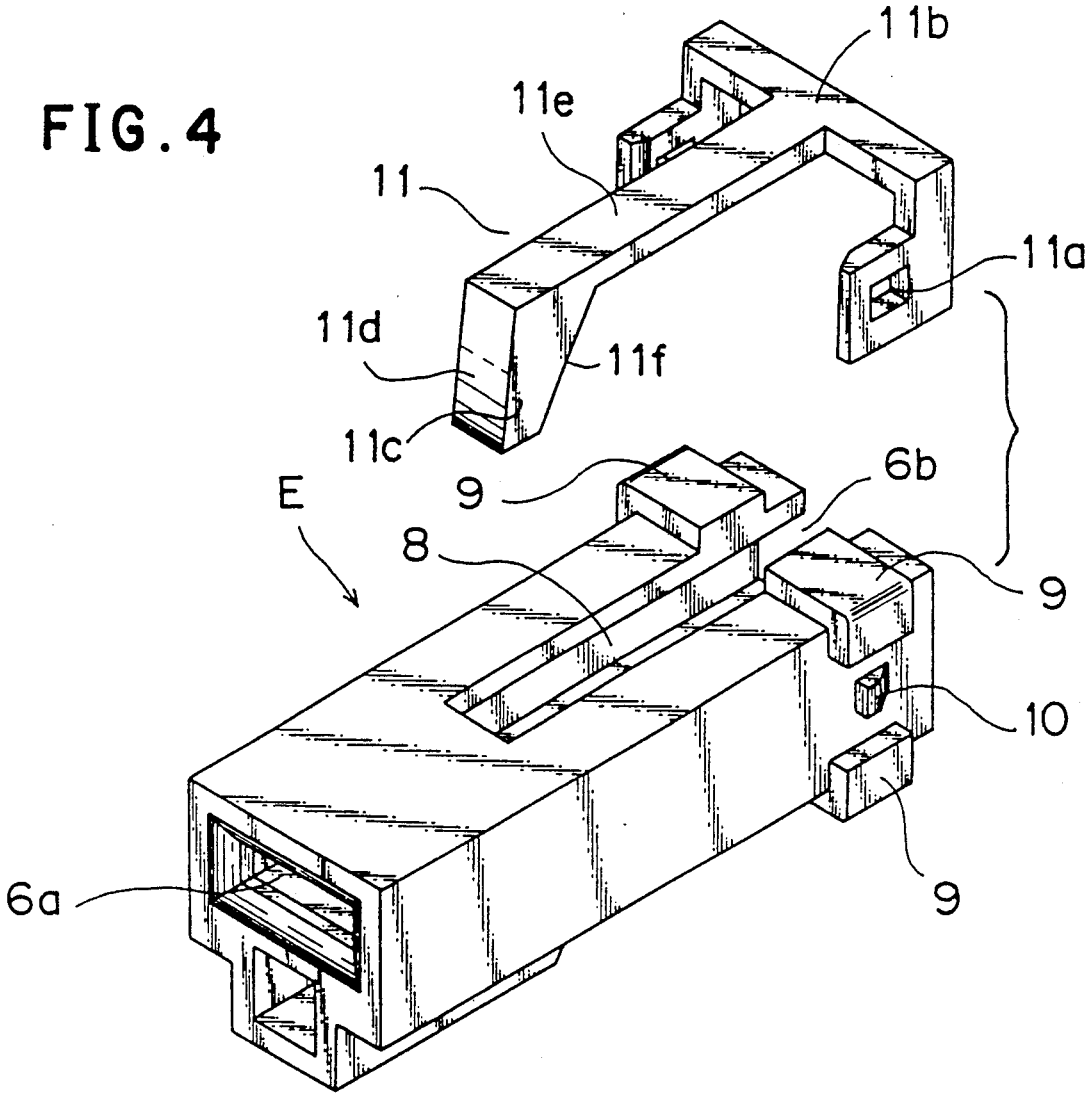
FIG. 4 is a perspective view of the connector housing and the release bar, separated from each other.
Figure 5:
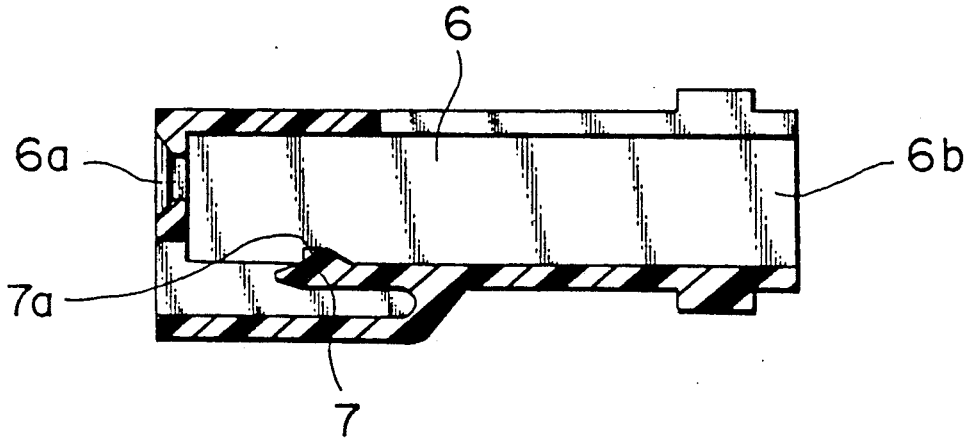
FIG. 5 is a cross section of the connector housing.

As shown in FIGS. 4 and 5, the connector housing E has a terminal accommodating chamber 6 therein with a male terminal insertion opening 6*a* formed at the front and with a female terminal insertion opening 6*b* at the back. In the terminal accommodating chamber 6 there is the lance 7, which has an engagement projection 7*a* at the tip. In the top portion of the surrounding wall of the connector housing E is formed an opening 8, which is cut in the top wall from the center toward the rear so as to communicate with the female terminal insertion hole 6*b* as well as the terminal accommodating chamber 6. The housing E has a rib-like stopper 9 formed near the female terminal insertion opening 6*b*, except at the top opening 8 and at the central area of the sides of the housing. Where the stopper 9 is not provided at the sides of the connector housing, there are engagement projections 10.

A release bar 11 is formed separate from the connector housing E and has a roughly U-shaped base portion 11*b* at the rear that fits with the stopper 9. Formed at both ends of the base portion 11*b* are fixing portions 11*a* that fit in the area of the sides of the housing where the stopper 9 is not formed. The release bar 11 also has an operating portion 11*e* and a release portion 11*c* at the front of the former. The release portion 11*c* has a release surface 11*d* at the front that is disposed almost perpendicular to, and engages with, the male terminal (described later). At the back the release portion 11*c* has a tapered portion 11*f*.

The release bar 11 is fitted in the connector housing E from above or back until the fixing portions 11*a* ride over the engagement projections 10 of the connector housing E, which fit in the hole of each fixing portion 11*a*. At the same time, the front surface of the of the stopper 9, thus positioning the release bar 11. The release portion 11*c* at the front end of the operating terminal accommodating chamber 6.

Next, by referring to FIG. 6, the action of the connector of this invention will be explained.

First, the release bar 11 is assembled onto the connector housing E beforehand. Then, the female terminal D is inserted from the female terminal insertion opening 6*b* at the back into the terminal accommodating chamber 6 in the connector housing E. The female terminal D is crimped at the wire crimping portion $D_2$ with a wire 12 beforehand. As the female terminal D advances in the terminal accommodating chamber 6, its front end abuts against the tapered portion 11*f* of the release bar 11. It then slides along the tapered surface, pushing up the operating portion 11*e*, and slides over the lance 7 in the housing. As it further advances, the front end 7*a* of the lance 7 enters into the engagement hole 1*a*, holding the female terminal D in position in the connector housing E. At this time, the release portion 11*c* snaps into the recess 3*c* of the top plate 3 (FIG. 2) by its own elasticity, the operating portion 11*e* returns to its original flat condition, and the front surface 11*d* of the release portion 11*c* is almost in contact with the recess 3*c* of the top plate 3 of the female terminal D.

While in the above example the release bar 11 is fitted in the connector housing beforehand, it may be assembled after the female terminal D is installed. Now, the connector assembly is complete.

Next, the male terminal G is inserted from the male terminal insertion opening 6*a* of the connector housing E until it is accepted in the male terminal receptor portion $D_1$ of the female terminal D. The male terminal G is inserted between the top plate 3 of the female terminal D and the resilient tongue 4. The raised projection 5 on the resilient lock piece 4*b* fits into an engagement hole 13 cut in the male terminal G, thereby locking the two mating terminals. The male terminal G is pressed against the contact projections 3*b* on the top plate 3 by the elasticity of the resilient tongue 4 and by the reactionary force of the pressing pieces 4*c* whose front ends are pressed against the base plate 1. Thus, the contact pressure between the mating terminals are sufficiently high assuring a reliable electrical connection.

If the length of the male terminal G, $l_1$, is longer than the distance from the front surface of the connector housing E to the front end surface 11*d* of the release portion, $l_2$, then the front end surface 11*d* will work as a stopper. The female terminal D is doubly prevented from slipping off from the back of the connector housing E by the lance 7 and by the recess 3*c* abutting against the release portion 11*c*.

The free end of the resilient lock piece 4*b* is almost parallel with the base plate 1, so that it is not subjected to an undesired force from the male terminal G that may cause deformation.

Next, the process of disengaging the male and female terminals G, D from each other will be described.

Figure 6:
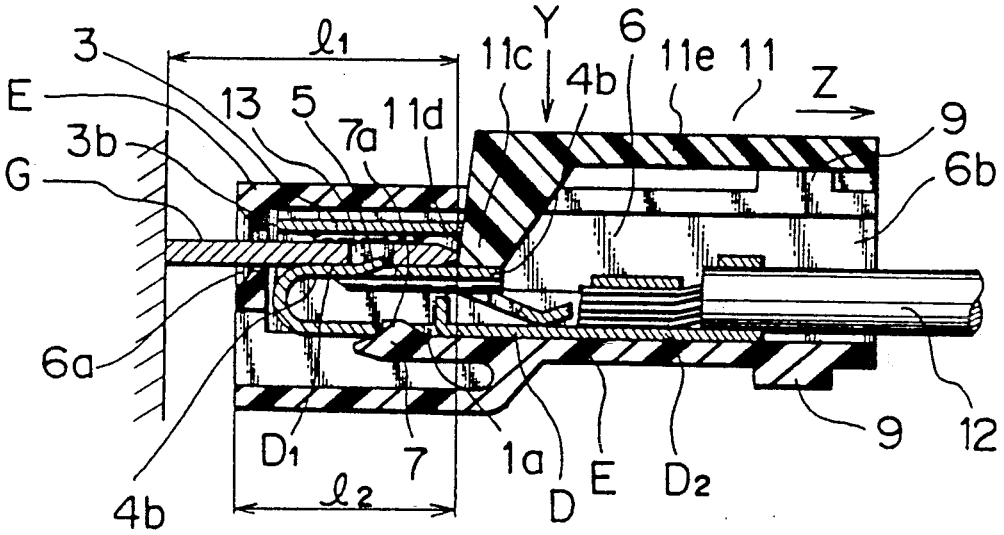
FIG. 6 is a cross section taken along the line A—A of FIG. 1, with a male terminal inserted into the connector.

Under the engaged condition as shown in FIG. 6, the front release portion 11*c* of the release bar 11 is applied with a force in the direction of arrow Y. The free end of the resilient lock piece 4*b* is pressed down, causing the raised projection 5 to come off the engagement hole 13 of the male terminal G. Then, the connector housing E is applied with a force in the direction of arrow Z, releasing the male terminal G from the female terminal D.

Figure 7:
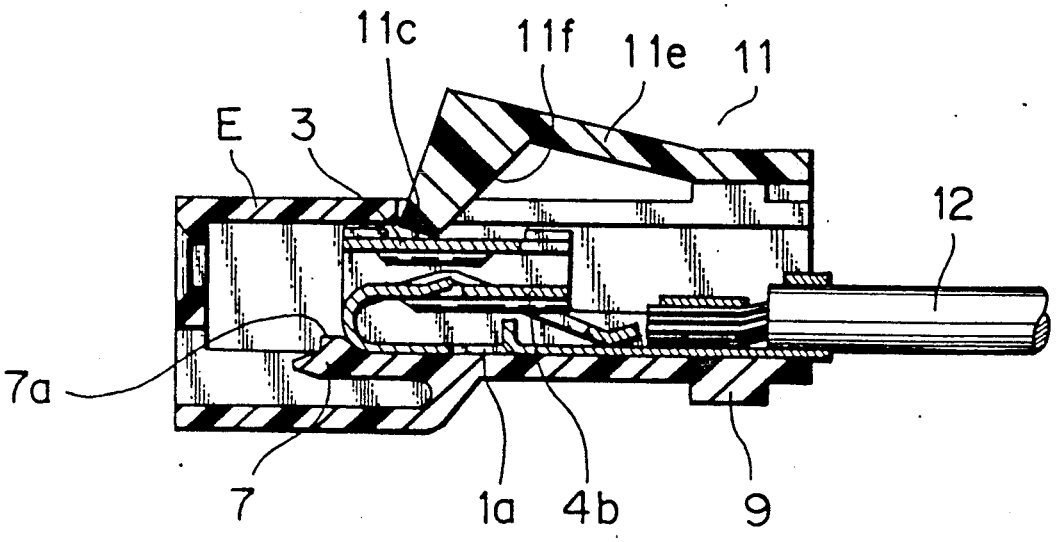
FIG. 7 is a cross section showing the female terminal incompletely installed in the connector housing.

Now, turning to FIG. 7, we will explain how the incomplete mounting of the female terminal D can be prevented.

If the front end 7*a* of the lance 7 fails to fit into the engagement hole 1*a* of the female terminal D, the front release portion 11*c* of the release bar 11 rests on the top plate 3 of the female terminal D, making the release bar 11 protrude from the connector housing E so markedly that an assembly worker can easily notice it from outside, a sign that the female terminal D is not mounted in correct position.

Where the release bar 11 is fitted onto the connector housing E from the back after the female terminal D has been mounted, the female terminal D, if it is mounted imperfectly, will be pushed forwardly to its correct position by the front release portion 11*c*.

The release bar 11 may be formed otherwise in shape or have other housing engagement structures as long as it has the release portion 11*c* and front surface 11*d* to move the resilient lock piece 4*b* in a direction perpendicular to the mating terminal engagement direction.

Figure 8A:
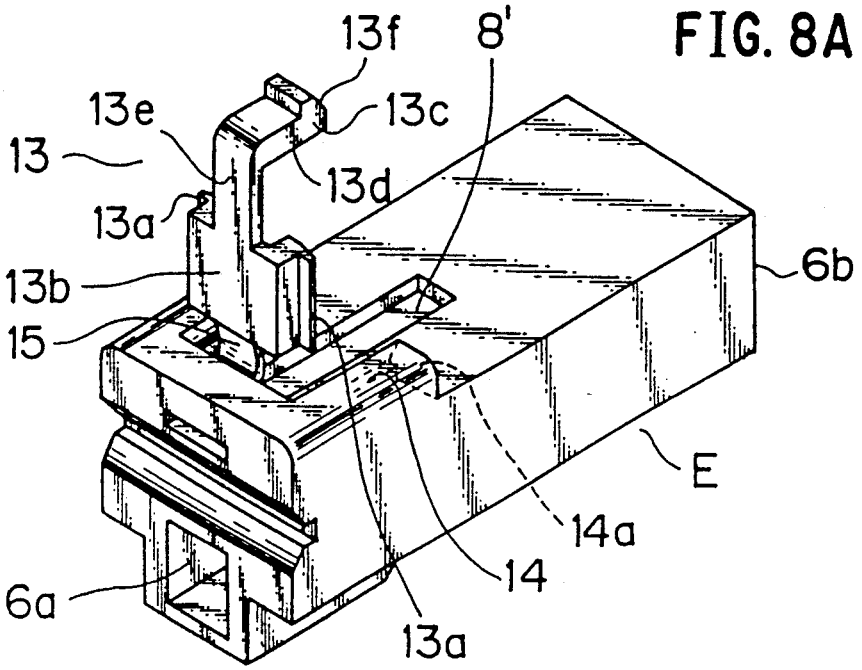
FIG. 8A is a perspective view of a connector housing of another embodiment of this invention.
Figure 8B:
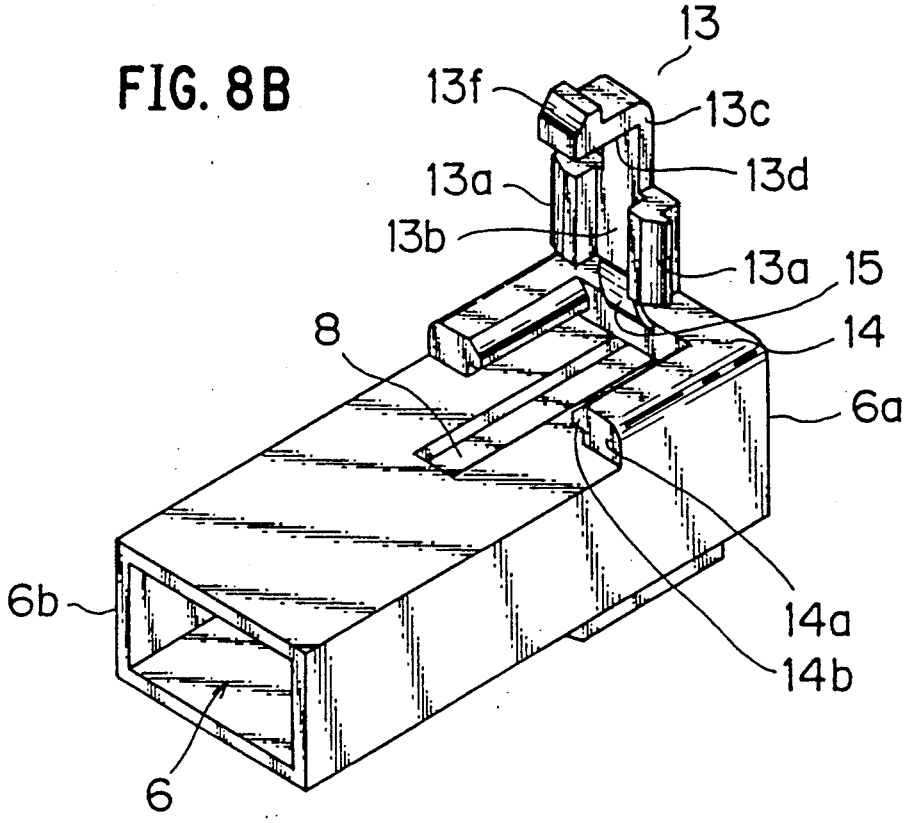
FIG. 8B is a perspective view of the connector housing of FIG. 8A as seen from the opposite side.
Figure 9A:
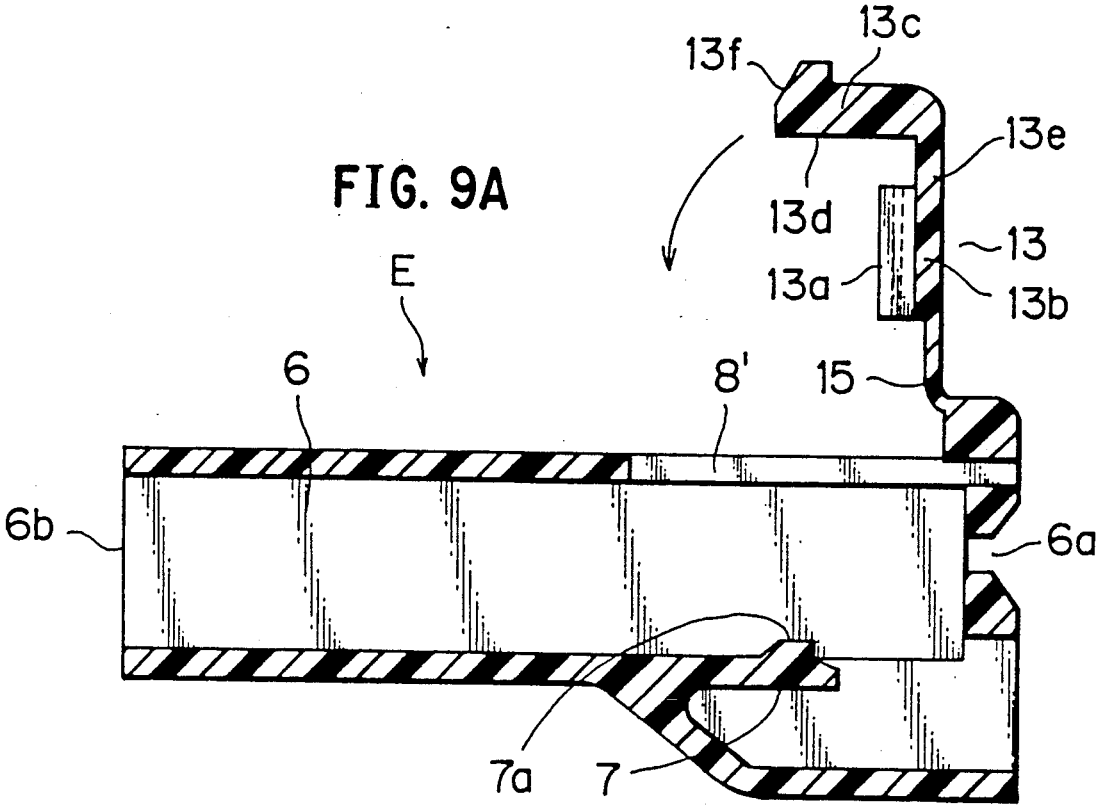
FIG. 9 is a longitudinal cross section of the connector housing of FIG. 8B taken along the center line.

In the connector housing E shown in FIGS. 8A, 8B and 9, a release bar 13 is connected to the connector housing E through a hinge 15. That is, on the side of the male terminal insertion opening 6*a*, the connector housing E is formed with a roughly U-shaped engagement frame 14 as well as an opening 8'. The release bar 13 is coupled to the engagement frame 14 through the hinge 15. The release bar 13 has a plate-like base portion 13*b* with fixing portions 13*a* on each side, an operating portion 13*e* extending backwardly from the base portion 13*b*, and a release portion 13*c* at the rear end of the operating portion 13*e*. The release portion 13*c* has a release surface 13*d* at the front and a tapered surface 13*f* at the back. The side walls 14*a* of the engagement frame 14 have an engagement claw 14*b* projecting from the upper part thereof to engage with the fixing portions 13*a* of the release bar 13.

In this embodiment, when the release bar 13 is pushed in the direction of the arrow in FIG. 9, the fixing portions 13*a* on each side of the release bar 13 move down to ride over and beyond the engagement claws 14*b* of the engagement frame 14 so that the release bar 13 is locked in the connector housing E. Thus, unlike the release bar 11 mentioned earlier, there is no need to mount it on the housing and no possibility of the assembly worker forgetting to attach the release bar to the housing. This in turn improves the efficiency of the connector assembly work. This construction also has the advantages that if the hinge 15 should be broken, the release bar 13 will not come off the connector housing because of the locking between the fixing portions 13*a* and the engagement claws 14*b*.

Figure 10:
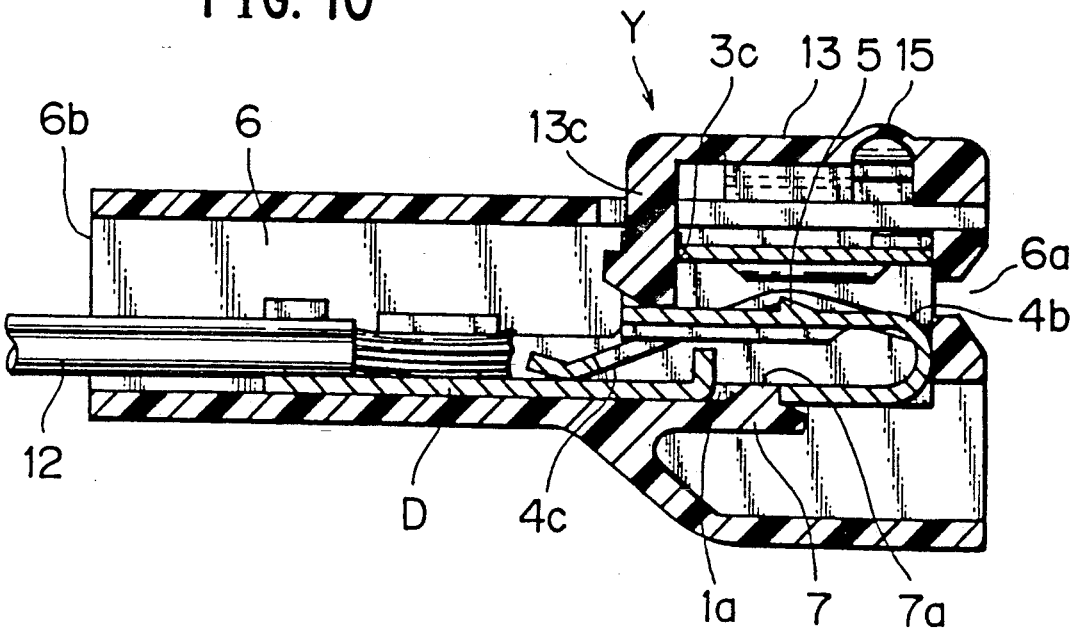
FIG. 10 is a longitudinal central cross section of the connector housing of FIG. 9 with the female terminal installed therein.
Figure 11:
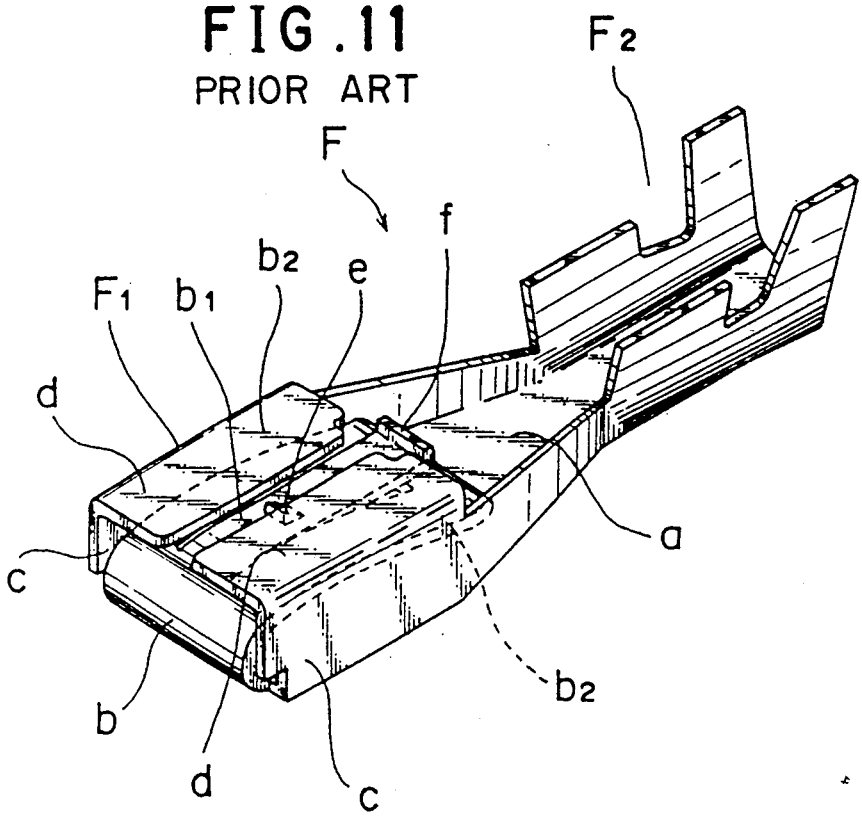
FIG. 11 PRIOR ART
FIG. 11 is a perspective view of a conventional female terminal.
Figure 12:
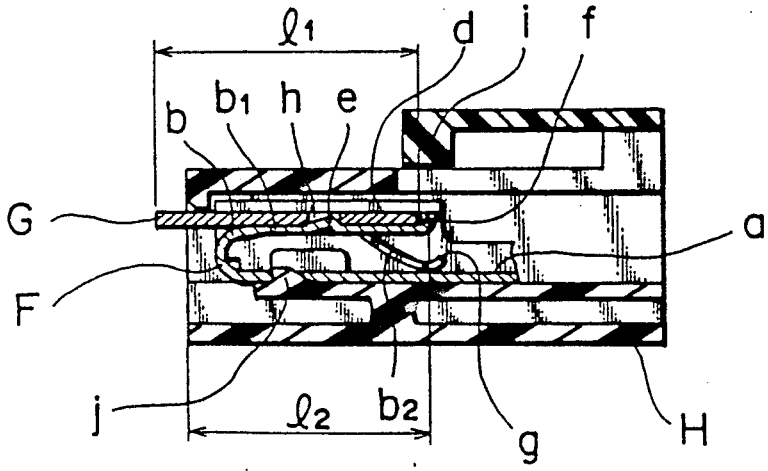
FIG. 12 PRIOR ART
FIG. 12 is a cross section of the conventional connector with the female terminal and male terminal engaged.

As shown in FIG. 10, the release portion 13*c* of the release bar 13 has its front release surface 13*d* engaged with the recess 3*c* of the top plate 3 of the female terminal D, thereby doubly locking the female terminal in combination with the lance 7. Because the release bar 13 engages with the connector housing E through the fixing portions 13*a* and the engagement claws 14*b* over a significantly wide area, the double locking force is increased.

Furthermore, when the release portion 13*c* is pressed in the direction of arrow Y in FIG. 10 to release the mating male terminal G (see FIG. 6) from the resilient lock piece 4*b*, the male terminal G can be reliably unlocked because the direction of deflection of the resilient lock piece 4*b* coincides with that of the release bar 13.

As described above, with this invention, the resilient tongue of the female terminal is prevented from being undesirably deformed by the force of the incoming male terminal and therefore the mating terminals can be connected with a stable contact pressure.

Where the release bar is formed integral with the connector housing or it is fitted in the connector housing from above beforehand, any incomplete mounting of the female terminal inside the connector housing will cause the release bar to float up to a degree easily recognizable from outside, thus alerting the assembly worker to the incorrect mounting. This in turn prevents a possible connection failure of the mating terminals which would otherwise go unnoticed.

Where the release bar is fitted from the back after the female terminal has been inserted into the connector housing, the female terminal, if incompletely mounted, can be pushed to the correct position by the advancing release bar.

In either case, the connector of this invention has many functions such as engaging and disengaging the male and female terminals, checking for any incomplete mounting of the female terminal in the connector housing, and double locking of the female terminal. These functions combine to ensure highly reliable terminal connection.

What is claimed is:

1. An electric connector comprising:

a connector housing having a terminal accommodating chamber therein and an opening formed in a surrounding wall, the opening communicating with the terminal accommodating chamber inside the connector housing;

a female terminal installed in the terminal accommodating chamber in the connector housing, the female terminal having a lock mechanism to lock an incoming male terminal, the female terminal further comprising:

a base plate;

a male terminal receptor portion formed integral with a front part of the base plate, the male terminal receptor portion being formed into the shape of a channel or frame;

a wire connecting portion formed integral with the rear part of the base plate; and a resilient tongue formed by reversely folding the base plate at the front end of the male terminal receptor portion so that the folded part of the base plate extends rearwardly until its free end projects from the rear end of the male terminal receptor portion and is also exposed from the opening of the connector housing; and a lock release bar having a front end portion disposed in the opening of the connector housing, the front end of the lock release bar being in contact with the resilient tongue and also movable in a direction almost perpendicular to the resilient tongue to release the lock between the mating terminals said lock release bar being adapted to block an advancing male terminal within said male terminal receptor portion when said front end of the lock release bar extends through the opening of the connector housing into said male terminal receptor portion.

2. An electric connector as set forth in claim 1, wherein the lock release bar consists of an operating portion that can be resiliently displaced vertically through the opening of the connector housing and a release portion at the front end of the operating portion that projects downwardly, and the lock release bar is connected to the connector housing through a hinge.

3. An electric connector as set forth in claim 2, wherein the lock release bar has a tapered surface at the back of the release portion.

4. An electric connector as set forth in claim 2 or 3, wherein the front surface of the release portion is formed as a vertical surface that engages with the male terminal.

5. An electric connector as set forth in claim 1, wherein the lock release bar consists of an operating portion that can be resiliently displaced vertically through the opening of the connector housing and a release portion at the front end of the operating portion that projects downwardly, and a rear end portion of the release bar can be removably mounted on the connector housing.

6. An electric connector as set forth in claim 5, wherein there is a lock means between the base portion and the housing.

7. An electric connector as set forth in claim 6, wherein the surrounding wall of the connector housing is provided with a stopper that engages with the rear end portion of the operating portion.

* * * * *